US010834962B2

(12) United States Patent
Romero

(10) Patent No.: US 10,834,962 B2
(45) Date of Patent: Nov. 17, 2020

(54) SMOKING DEVICE

(71) Applicant: Roger Romero, Naples, FL (US)

(72) Inventor: Roger Romero, Naples, FL (US)

( * ) Notice: Subject to any disclaimer, the term of this patent is extended or adjusted under 35 U.S.C. 154(b) by 0 days.

(21) Appl. No.: 16/024,883

(22) Filed: Jul. 1, 2018

(65) Prior Publication Data

US 2020/0046017 A1 Feb. 13, 2020

(51) Int. Cl.

| | |
|---|---|
| ***A24F 1/28*** | (2006.01) |
| ***A24F 5/08*** | (2006.01) |
| ***A24F 1/32*** | (2006.01) |

(52) U.S. Cl.

CPC ..... *A24F 1/28* (2013.01); *A24F 1/32* (2013.01); *A24F 5/08* (2013.01)

(58) Field of Classification Search

CPC ..... A24F 1/28; A24F 5/08; A24F 1/32
See application file for complete search history.

(56) References Cited

U.S. PATENT DOCUMENTS

| | | | | |
|---|---|---|---|---|
| 6,073,633 A * | 6/2000 | Herman | ..... | A24F 3/02 131/174 |
| 2017/0231283 A1* | 8/2017 | Gadas | ..... | A24F 7/02 131/329 |

* cited by examiner

*Primary Examiner* — Eric Yaary
*Assistant Examiner* — Jennifer A Kessie

(57) ABSTRACT

The present invention is a smoking device comprising a glass housing having forward and rear open end portions and an inner portion. The smoking device further comprises a mouthpiece engaged with the rear open end portion of the housing. The smoking device includes screen member that is movable along the inner surface of the housing in response to the application of a magnetic field thereto. The magnetic field may be created by a power source located on a spacer member along the exterior surface of the housing or a power source associated with the screen member along the inner surface of the housing. The application of the magnetic field causes the corresponding movement of a screen member in the interior of the housing in response to the application of a magnetic force.

2 Claims, 7 Drawing Sheets

SMOKING DEVICE

BACKGROUND OF THE INVENTION

The present invention relates to smoking devices such as pipes used by a person to smoke or consume a smoking material such as tobacco, medical marijuana, or the like. Various conventional smoking devices have been designed. Such conventional devices are not designed for optimum performance, comfort, versatility, ease of use, portability, or fabrication.

One of the problems faced by manufacturers over the years is how to produce and market easy-to-use products for consumers that have grown accustomed to traditional methods of dry herb use. The products themselves may be incredibly useful and efficient, but they are useless unless consumers believe that these products will supplement or enhance their sessions. The problem for some consumers is that these products may often either be too expensive or be too advanced for their liking; after all, if you're looking for a smoking product that is not too great of a departure from your traditional smoking methods, the move to a battery-powered device may be a leap too far.

One simple approach is the use of a product referred to as a glass blunt. This device offers a traditional dry-herb smoking experience while upgrading the hardware so that it is more portable, convenient, and enjoyable for the consumer. Blunts have long been used alongside joints and glass pipes and bongs as one of the primary methods of imbibing dry herbs. Yet while blunts are a tried-and-true method of delivering massive amounts of smoke for relatively cheap, there are a number of drawbacks to their use.

For starters, a consumer will have to regularly re-supply themselves with blunt wraps or papers in order to regularly enjoy blunts. This can be tiresome, particularly for the lazier lovers of dry herb who can't be bothered to regularly re-up their stock. Another problem is the issue of how to actually roll a blunt. Any person who has ever tried it knows that rolling a blunt can be a difficult process to master, as it requires patience to navigate the multiple steps involved. And if the blunt wrap should happen to tear while you're rolling, the consumer may find himself up a certain creek without a paddle.

Another consideration for those who regularly smoke blunts is the issue of hygiene. The person rolling the blunt must wet most of the blunt wrap to fuse the blunt together. Most consumers do not mind this aspect of the process; however, for those who are concerned about the germs involved, the blunt can be an unattractive smoking option. Lovers of blunts are thus left with a dilemma: having roughly the same smoking experience of a blunt without having to deal with the issues of re-stocking the supply of blunt wraps, having to roll the blunt, and hygiene considerations that arise from licking the wraps.

One type of commercially available glass blunt resembles a syringe. In one commercially available device, the dimensions are described as being 4 inches long with an 11 mm diameter and a capacity of 1 to 1.5 grams of dry herb. In this device, inner and outer cylinders are movable relative to each other. The inner cylinder includes a screen on the front end to allow the smoke to pass therethrough to the mouthpiece. The screen also acts as a stop to allow the dry herb to be compacted in the forward end of the device. Movement of the inner cylinder forwardly relative to the outer cylinder also allows the user to push the ash forward from the interior of the glass blunt. This allows the user to remove the burnt herb from the device while still using the device. When the user is finished, the user may just place a cap on the front end of the device to extinguish the burning herb and save it for later use. This device includes a mouthpiece on the back end of the device to allow the user to inhale the smoke from the burning herb through the inner cylinder. Although this device is simply constructed, the push/pull of the inner and outer cylinders may lead to situations where the dry herb is accidentally pushed out of the front of the outer cylinder or pulled too far into the outer cylinder. Additionally, the use of two glass cylinders renders this type of device more susceptible to breakage or may be too long for some users when fully packed.

U.S. Patent Application No. US20160235115A1 filed by Han discloses a glass blunt which is a cylindrical smoking apparatus that resembles a long pipe. It may be used to smoke dry herbs. The glass blunt comes equipped with multi-holed titanium mouthpiece that is attached to a long corkscrew-like implement. The corkscrew like implement can be used to grind the dry herbs that are placed into the cylinder and also pack the dry herbs. This process is accomplished by screwing in the titanium mouthpiece, which serves to both grind the dry herbs and to secure or pack them in place for when they are smoked. After the mouthpiece is screwed in, all that is left for the consumer is to remove the silicone cap at the opposite end of the mouthpiece and to smoke the dry herb. The Han device is accompanied by a silicone cap used to place over the opposite end of the cylinder from the mouthpiece, to ensure that herbs packed into the glass blunt may be stored safely for later use. In this device, the mouthpiece is rotated relative to the cylinder to move the ash forwardly in the cylinder using the corkscrew member. In the Han device, it may require the use of two hands to rotate the mouthpiece due to resistance between the O-ring along the mouthpiece and the cylinder. Additionally, the mouthpiece must be cleaned relatively often due to resin buildup along the corkscrew and mouthpiece and the device is unable to retain as much dry herb as the standard glass blunt due to the existence of the corkscrew in the interior of the cylinder.

SUMMARY OF THE INVENTION

The present invention is a smoking device that may be used by a person to consume or smoke a smoking material such as tobacco, medical marijuana, or the like. The smoking device comprises a glass housing having uniform inner and outer surfaces with open ends. The front end of the device is open to allow for the addition of the dry herbs into the device. The back end includes a removable mouthpiece to close the back end. The mouthpiece comprises a front surface, a rear surface, and one or more air passage ways extending from the front surface to the rear surface of the mouthpiece and in communication with the inner portion of the housing. The mouthpiece of the present invention may also be an integral tapered end piece or a removable member as described below.

The present device includes one or more magnetic members that allow the screen member to be moved forwardly and rearwardly through the cylinder by the user. The screen member may be a metallic member, ferromagnetic or a magnetic member having one or more openings therein. A spacer member is positioned along the outer surface of the cylinder to allow for the movement of the screen member in response to the movement of the magnetic member. Because the screen member may be metallic and/or magnetic, movement of the magnetic member causes the movement of the screen member along the interior surface of the cylindrical member. Similarly, the inner member may be formed of a magnetic material while the outer member is metallic or ferromagnetic such that movement of the inner member is caused by magnetic forces between the two members. The magnetic members and magnetic field of the present invention may be strengthened, re-directed, cancelled and/or reduced through known arrangements and/or shapes of magnetic members or with the addition of ferro-magnetic materials such as steel. One known arrangement is known as a Halbach cylinder, which is a magnetized cylinder composed of ferromagnetic material producing (in the idealized situation) an intense magnetic field confined entirely within the cylinder with zero magnetic field outside (ideal for the spacer member). The Halbach cylinders may also be magnetized such that the magnetic field is entirely outside of the cylinder with zero magnetic field inside (ideal for the screen member). Alternate forms of the present invention include an electromagnetic field coil device wherein the spacer and/or the screen member includes a power source and coils to energize a magnetic field to control movement of the screen. Yet another approach is through the use of a coiled field wherein the coil extends along the outer or interior surface of the housing. When the coils are activated, the screen moves along the interior of the housing in response to the application of the electromagnetic source. In each of these alternate embodiments, a power source such as a battery is used. Advantages of these embodiments include the screen member moving passively in response to the inhalation by the use and that the smoking device does not emit a magnetic field until the power source is activated. This allows the user to store the smoking device in their pocket or carrying case without affecting keys, coins or other metal objects in their pockets or purses.

The screen member is preferably substantially solid with a single opening or a porous surface to allow smoke from the burned herb to pass therethrough. The surface of the screen member allows the user to pack the dry herb into the forward end of the glass cylinder while holding the outer magnet member to retain the screen member in the desired location. The configuration of the screen member is designed to allow the smoke to pass therethrough while minimizing the likelihood of clogging due to resin and also forming a surface against which the dry herb can be packed. When the user desires to light the dry herb, the user may move the outer spacer member forward a small distance to expose the compacted dry herb to the ignition source. As the dry herb is burning, the outer spacer may be moved rearwardly to assist in the burning. As the dry herb is further burned, the spacer member may be moved forwardly to allow the user to remove the ash from the forward end of the device. The smoke from the burned herb passes through the screen to the mouthpiece on the back end of the cylinder. When the user is finished smoking the dry herb, the dry herb may be allowed to extinguish itself or a cap may be placed on the forward end of the cylinder to starve the dry herb of oxygen. The device may then be stored for future use.

BRIEF DESCRIPTION OF THE DRAWINGS

The following description of the invention will be more fully understood with reference to the accompanying drawings in which.

DESCRIPTION OF THE INVENTION

Figure 1:
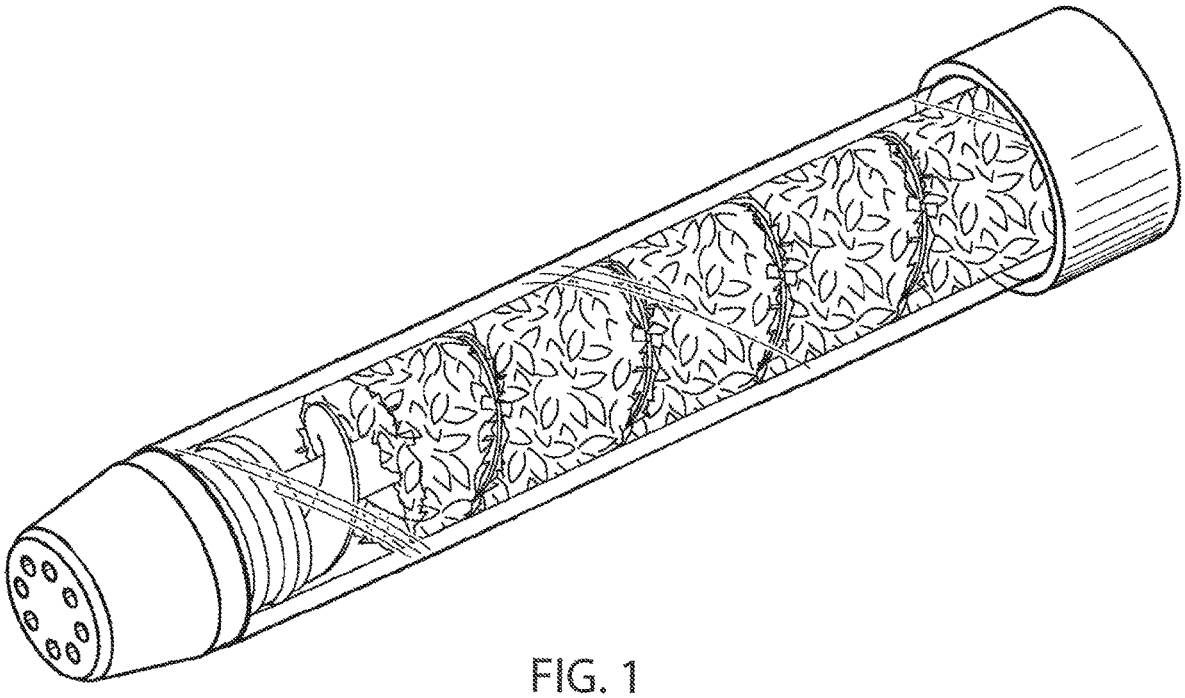
FIG. 1 Prior Art
FIG. 1 is a prior art perspective view of a smoking device.
Figure 2:
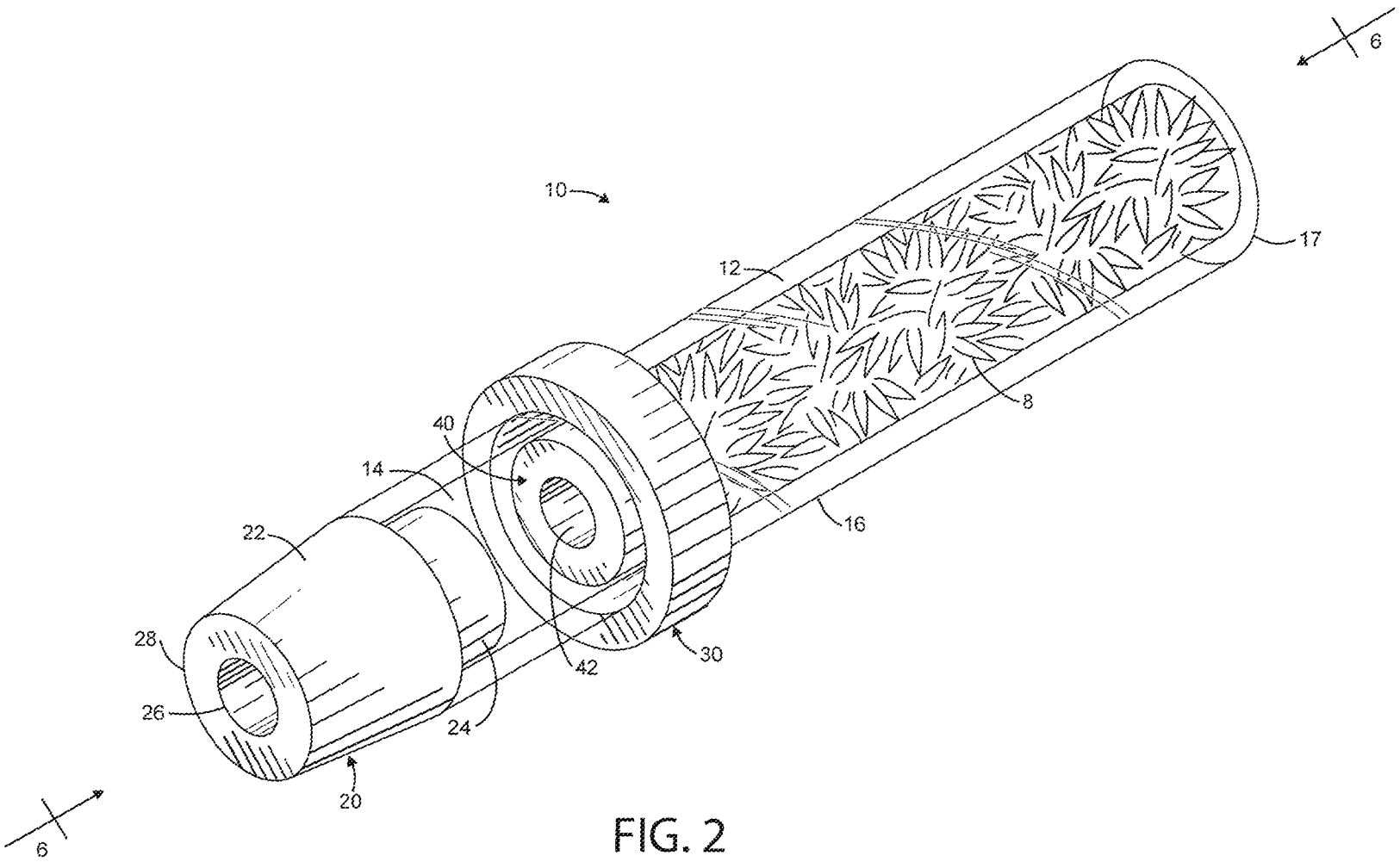
FIG. 2 is a front perspective view of a smoking device according the present invention.
Figure 3:
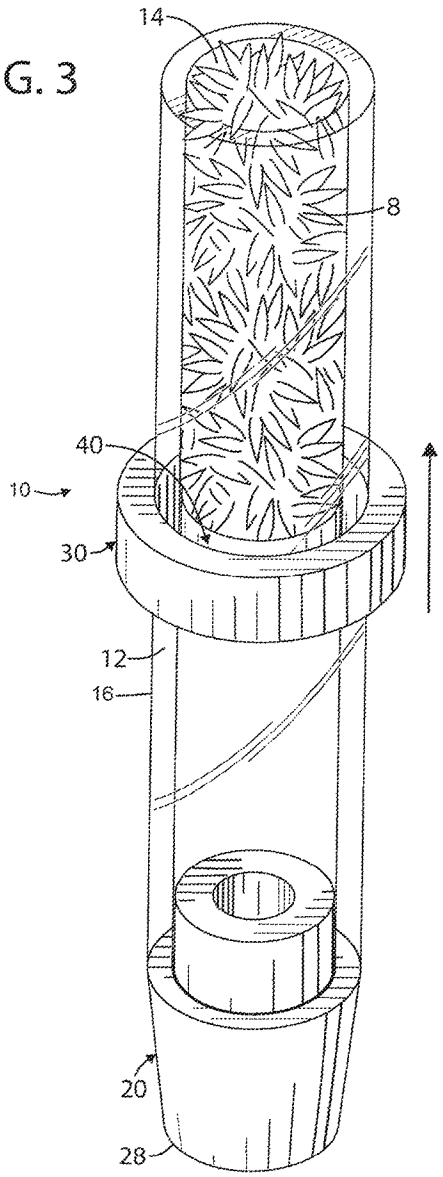
FIG. 3 is a front perspective view of a smoking device according the present invention with the spacer and screen member positioned midway along the cylinder.
Figure 4:
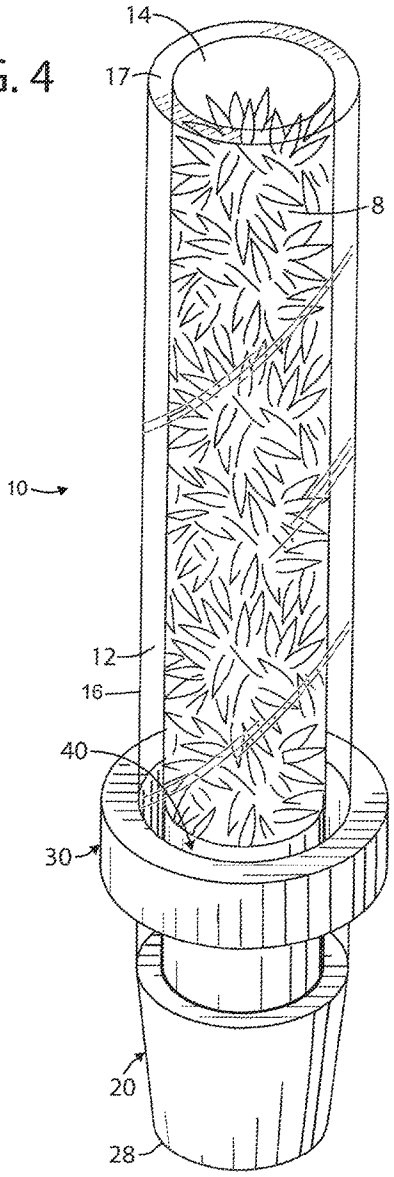
FIG. 4 is a front perspective view of a smoking device of the present invention with the spacer and screen positioned rearwardly along the cylinder.
Figure 5:
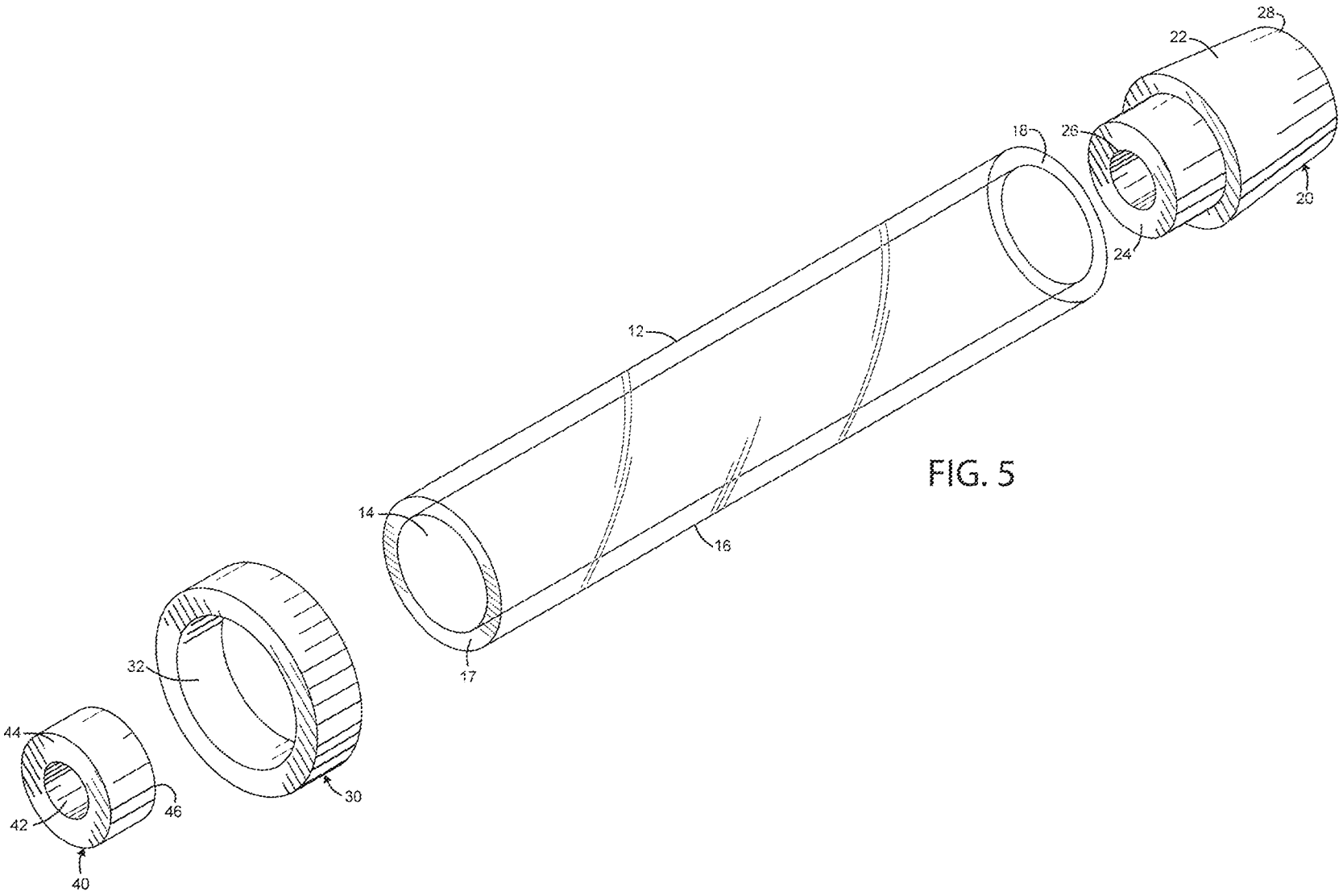
FIG. 5 is an exploded view of the smoking device.
Figure 6:
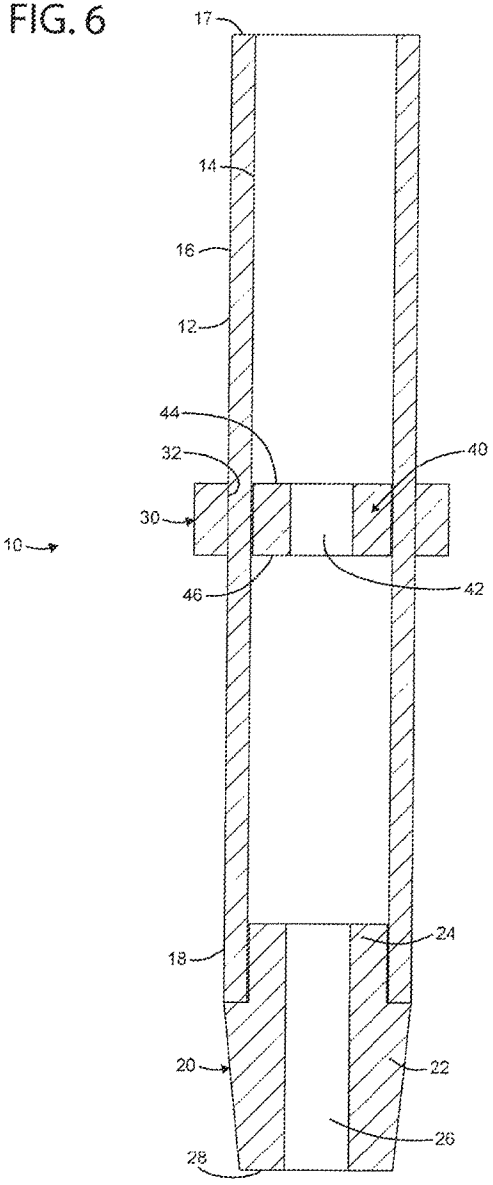
FIG. 6 is a cross-sectional view taken along line 6-6 of FIG. 2.

FIG. 1 is illustrative of a Prior Art smoking device. FIGS. 2-6 are illustrative of the smoking device of the present invention. The smoking device 10 of the present invention may be used by a person to smoke or consume a smoking material 8 such as tobacco, medical marijuana or the like. Smoking device 10 generally comprises an elongate and generally cylindrical housing 12, a mouthpiece 20, and a spacer 30. The cylindrical device 12 is preferably an elongate member having a smooth inner surface 14 and a substantially smooth outer surface 16. The cylindrical housing 12 also includes a forward end 17 for the insertion of dry herb therein and a back end 18 for the attachment of the mouthpiece 20 thereon. The cylindrical housing 12 is preferably made of a heat resistant material such as a glass quartz, borosilicate or similar materials. Other materials may be used for the cylindrical housing 12 to provide heat resistance, durability and aesthetic appeal. As will be described more fully herein, movement of spacer 30 causes the corresponding movement of the screen member 40.

The body 22 of mouthpiece 20 is generally cylindrical and is made from brass or any other heat resistant material such as a plastic or metal and fabricated by conventional processes. The material and shape of the mouthpiece preferably assists in dissipating the heat of the smoke. The mouthpiece 20 includes a forward end 24 that is shaped to frictionally fit within the back end 18 of the cylindrical housing 12. As shown in the drawings, the mouthpiece includes a central passageway 26 that extends therethrough from the forward end 24 to a tapered back end 28. The back end 28 is tapered to allow the user to put their lips on the smoking device 10 and draw smoke from the device. The mouthpiece 20 may also be used to attach to other devices for water filtration, water cooling or accumulating smoke in a larger chamber. Additionally, the smoking device 10 may be attached to a device that is used to divide smoke passage to multiple users.

The spacer 30 is preferably formed of a magnetic material to cause the corresponding lateral movement of the screen member 40 located along the inner surface 14 of the cylindrical housing 12. The inner surface 32 of the spacer 30 is configured to smoothly travel along the outer surface 16 of the cylindrical housing 12 with minimal frictional resistance. The inner surface 32 of the spacer 30 may include a silicone or similar material thereon to assist with the movement of the spacer 30 along the cylindrical housing 12. Forward or rearward movement of the spacer 30 along the outer surface 16 of the cylindrical housing magnetically causes the corresponding movement of the screen member 40 along the interior of the cylindrical housing. In the preferred from of the present invention, both the spacer 30 and the screen member 40 are magnetic members to allow for the coordinated movement therebetween. In an alternate form of the present invention, one of the of the spacer 30 or screen member 40 may be magnetic while the other member is movable in response to the application of the magnetic field. Alternately, although the spacer 30 is shown as a cylindrical member, it is anticipated that it may be formed as a variety of shapes wherein finger members are provided on the exterior surface thereof or one or more separate magnets are utilized. The spacer may also include a shock resistant or protective housing to prevent damage. This may be made from a variety of materials including silicone. Variations of the configuration of the spacer may be utilized to facilitate the compact storage and durability of the smoking device as well as to conveniently allow the use to move the screen member 40 in response to the lateral movement of the spacer 30. Similarly, the configuration of the spacer 30, mouthpiece 20 and screen member 40 allow for the convenient disassembly of the smoking device for cleaning or transport.

The screen member 40 may include one or more passage ways 42 that are arranged between the front surface 44 and rear surface 46 of screen member 40. The air passage way 42 is preferably shaped in the form of a cylinder having a preferred inside diameter of approximately 1-7 mm and more preferably of about 6.35 mm. Any diameter that is significantly larger results in smoking material passing thru the air passage way. Any diameter that is significantly smaller reduces air flow. The diameter may be readily optimized depending on the number and shape of the desired air passageways as well as the type of smoking material 8 being used in the smoking device 10.

As shown in FIGS. 2-5, the smoking device 10 includes the forward end 17 of the cylindrical housing 12. The user may pack the smoking material 8 through the forward end 17 in a desired amount. The packing of the smoking material 8 may be facilitated by grasping the spacer 30 to retain the screen member 40 the desired distance from the front end 17 of the cylindrical housing 12. Once the desired amount of smoking material is packed into the cylindrical housing 12, the user may light the smoking material 8. As the smoking material 8 is burned, the spacer 30 may be moved forwardly or rearwardly to assist with the burning of the smoking material. The smoke from the smoking material 8 passes through the passage way 42 of the screen member 40. The smoke passes from the screen member 40 to a mixing chamber formed rearwardly of the screen member 40 and forward of the mouthpiece 20. The smoke passes from this chamber area to the forward end 24 of the mouthpiece 20. The smoke then passes through the central passage way 26 to the back end 28 of the mouthpiece 20 to the user.

The smoking device 10 may further include a cap (not shown) that is removably engaged with upper forward end portion 17 of the cylindrical housing 12. The cap is made from plastic and fabricated by conventional processes. The cap is provided so that housing 12 can be filled with smoking material and to prevent loss of smoking material during non-use and/or transport of smoking device 10 thereby making smoking device 10 easily portable. Cap may be made from a variety of materials such as silicone rubber and fabricated by conventional processes. Alternately, the cap may also include a magnetic member therein. When the spacer and/or the screen member are positioned on the opposite end of the cylinder from the cap, opposing forces from the spacer and/or the screen member and the magnetic cap member will cause the entire assembly to "float" due to the opposed magnetic force from a magnetic base positioned directly below the assembly.

Figure 7:
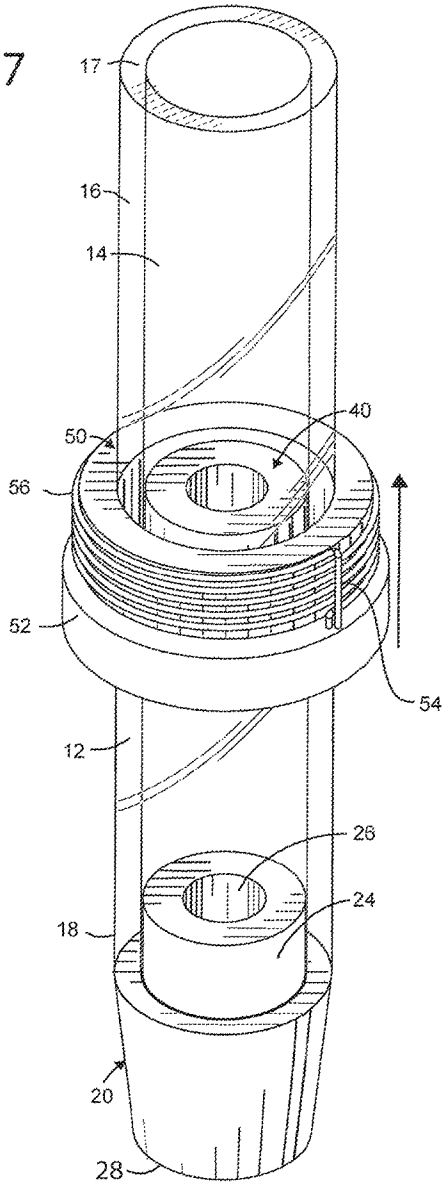
FIG. 7 is a cross-sectional view of an alternate embodiment of the present invention.

As shown in FIG. 7, the smoking device 10 of an alternate embodiment of the present invention may include a modified spacer 50. In this embodiment, the spacer 50 includes a power source 52, a switch 54 and coiled wires 56. As described above, the smoking device 10 of this embodiment generally comprises an elongate and generally cylindrical housing 12, a mouthpiece 20, and a spacer 50. The cylindrical device 12 is preferably an elongate member having a smooth inner surface 14 and a substantially smooth outer surface 16. The cylindrical housing 12 also includes a forward end 17 for the insertion of smoking material 8 therein and a back end 18 for the attachment of the mouthpiece 20 thereon. The cylindrical housing 12 is preferably made of a heat resistant material such as a glass quartz, borosilicate or similar materials. Other materials may be used for the cylindrical housing 12 to provide heat resistance, durability and aesthetic appeal and to promote the magnetic properties of the present invention. As will be described more fully herein, movement of spacer 50 causes the corresponding movement of the screen member 40.

The spacer 50 of this embodiment is preferably formed with a coiled wire 56 to create a magnetic field that causes the corresponding lateral movement of the screen member 40 located along the inner surface 14 of the cylindrical housing 12 as the spacer 50 is moved along the cylindrical housing 12. The spacer 50 is configured to smoothly travel along the outer surface 16 of the cylindrical housing 12 with minimal frictional resistance. The coiled wire 56 is formed of a sufficient width and thickness of copper or similar wires to create a magnetic field of a sufficient force to control the movement of the screen member 40 along the interior of the cylindrical housing 12. The coiled wire 56 is activated by a power source 52 such as a battery that is positioned along the exterior of the cylindrical housing 12. A switch member 54 is also formed as part of the spacer 50 to activate or deactivate the coiled wire 56. Although the present embodiment is shown with the power source 52, switch member and coiled wire 56 shown as integral components of the spacer 50, it is anticipated that each component may be separate or removable from the spacer 50 and may be provided with a variety of alternate configurations. This embodiment allows the user to control the application of a magnetic force to the screen member 40 such that the smoking device is non-magnetic until the coiled wire 56 is activated by the user. Forward or rearward movement of the spacer 50 along the outer surface 16 of the cylindrical housing magnetically causes the corresponding movement of the screen member 40 along the interior of the cylindrical housing 12 when the power source 52 activates the coiled wire 56. If the coiled wire 56 is not activated, the spacer is separately movable with respect to the screen member 40 and cylindrical housing 12. This feature allows the components of this embodiment to be easily removed and separately cleaned and stored as desired by the user. Alternately, multiple spacers may be utilized that are aligned one after another along the outer surface of the cylindrical housing. Therefore, when one spacer is actively retaining the screen member with its electromagnetic field, it decreases and/or shuts off its electromagnetic field as the next spacer turns on. This attracts the screen member to the next active spacer and so on until the screen member has been moved to the desired location or distance.

Figure 8:
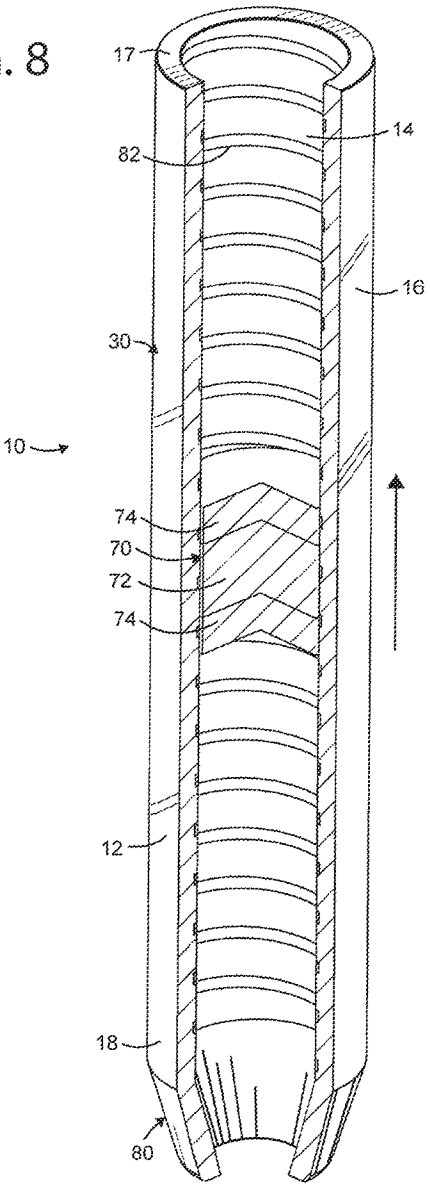
FIG. 8 is a cross-sectional view of an alternate embodiment of the present invention.

As shown in FIG. 8, the smoking device 10 of an alternate embodiment of the present invention may include a modified screen 70. In this embodiment, the screen 70 includes a power source 72, screen member 74 and a switch 76. As described above, the smoking device 10 of this embodiment generally comprises an elongate and generally cylindrical housing 12, a modified mouthpiece 80, and a screen 70. The cylindrical device 12 is preferably an elongate member having a preferably smooth inner surface 14 and an outer surface 16. The cylindrical housing 12 also includes a forward end 17 for the insertion of dry herb 8 therein and a back end 18 for the attachment of the modified mouthpiece 80 thereon. The cylindrical housing 12 is preferably made of a heat resistant material such as a glass quartz, borosilicate or similar materials. In this embodiment, the modified mouthpiece 80 is integrally connected to the back end 18 of the cylindrical housing and may be made of glass quartz, borosilicate, plastic, metal or similar materials. As will be described more fully herein, the inner surface 14 of the cylindrical housing preferably includes one or more coiled wires 82 circumferentially positioned thereon. The coiled wire 82 is exposed to the inner surface to make electrical contact with the magnetic screen members 74 of the screen 70. In this embodiment, activation of the power source and magnet components of the screen member 70 cause the corresponding movement of the screen member 70 along the coiled wire 82.

In this embodiment, activation of the coiled wire 82 creates an electromagnetic field that causes the corresponding lateral movement of the screen member 70 located along the inner surface 14 of the cylindrical housing 12. The screen surface 74 preferably consists of a pair of magnetized members that surround the power source 72. For example, a pair of neodymium magnets 74 may be placed along the ends of a battery such as an AA battery. The coiled wire 82 may be a 20-gauge copper wire. In this embodiment, a nonuniform magnetic field is formed inside the coiled wire 82 to cause the movement of the screen member 70 through the coil wire and cylindrical housing 12. The magnets of the screen surface 74 form north and south magnetic poles on the opposite ends of the power source 72. When the magnets contact or engage the coiled wire 82, the screen member is propelled through the coiled wire 82 in the cylindrical housing by the nonuniform magnetic force. As with the prior screen member described above, the screen member 70 of the present embodiment, includes one or more openings therein or therearound to allow the smoke from the smoking material 8 to pass to the mouthpiece 80. When the user withdraws smoke from the device, the screen surfaces 74 (magnets) and power source 72 (battery) are compressed and contacted or engaged with the coiled wire 82 to form the magnetic field that powers the screen member 70 through the coiled wire 82. This causes the screen member 70 to be moved laterally along the cylindrical housing 12. The screen member 70 is configured to smoothly travel along the inner surface 14 of the cylindrical housing 12 with minimal frictional resistance. The coiled wire 82 is formed of a sufficient width and thickness of copper or similar wires to create a magnetic field of a sufficient force to control the lateral movement of the screen member 70 along the interior of the cylindrical housing 12. Additionally, an optional switch member may be used to power the screen member 70 on an off by causing contact between the power source 72, screen surfaces 74 and the coiled wire 82. As the screen member 70 moves along the cylindrical housing 12, ash from the smoking material 8 is forced forwardly out of the forward end 17 of the cylindrical housing 12. When the user stops drawing on the modified mouthpiece 80, the screen surface 74, power source 72 are no longer compressed and the coiled wire 82 is no longer activated by the power source 72. Alternately, an airflow sensor diaphragm that changes capacitance when air is sucked over it and it is deformed may be used in the present invention. This functions as part of an oscillator circuit that produces a frequency output that a microcontroller reads to know when to supply power. This allows the diaphragm to detect the direction of air flow such that it is not turned on when the user blows into it.

The foregoing description is intended for purposes of illustration. The invention may be embodied in other forms or carried out in other ways without departing from the spirit or scope of the invention.

What is claimed:

1. A device for consuming a smoking material comprising:

A generally cylindrical housing comprising a forward open end portion, a rear end portion, and an inner and outer surface;

A screen member movable along the inner surface of the housing;

A spacer movable along the outer surface of the housing wherein forward or rearward movement of the spacer causes the screen member to correspondingly move along the inner surface of the housing and wherein said spacer is a cylindrical member movably extending along the outer surface of the housing; and A mouthpiece engaged with said rear end portion of said housing and said mouthpiece comprises a front surface, a rear surface, and a first air passage way extending from said front surface to said rear surface and in communication with said inner portion of said housing; and wherein the screen member is a generally cylindrical member having at least one passageway extending therethrough and wherein the screen member is movable forwardly and rearwardly along the inner surface of the housing in response to movement of the spacer along, the housing without physical contact between the spacer member and the screen member.

2. A device for consuming a smoking material comprising:

A generally cylindrical housing comprising a forward open end poliion, a rear end portion, and an inner and outer surface;

A screen member movable along the inner surface of the housing;

A spacer movable along the outer surface of the housing wherein forward or rearward movement of the spacer causes the screen member to correspondingly move along the inner surface of the housing and wherein said spacer is a cylindrical member movably extending along the outer surface of the housing; and A mouthpiece engaged with said rear end portion of said housing and said mouthpiece comprises a front surface, a rear surface, and a first air passage way extending from said front surface to said rear surface and in communication with said inner portion of said housing; and wherein movement of the spacer member along the housing causes the corresponding movement of the screen member along the housing via the application of a magnetic force thereto without physical contact between the spacer member and screen member.

* * * * *